US006668512B2

(12) United States Patent
Ray

(10) Patent No.: US 6,668,512 B2
(45) Date of Patent: Dec. 30, 2003

(54) LIGHTWEIGHT BUILDING COMPONENT

(75) Inventor: Manuel A. Ray, San Juan, PR (US)

(73) Assignee: Ray T. Forms, Inc., San Juan, PR (US)

( * ) Notice: Subject to any disclaimer, the term of this patent is extended or adjusted under 35 U.S.C. 154(b) by 0 days.

(21) Appl. No.: 10/075,187

(22) Filed: Feb. 14, 2002

(65) Prior Publication Data

US 2002/0088194 A1 Jul. 11, 2002

Related U.S. Application Data

(63) Continuation-in-part of application No. 09/433,593, filed on Nov. 2, 1999, now abandoned.

(51) Int. Cl.[7] ..... E04C 3/30

(52) U.S. Cl. ..... 52/730.1; 52/730.2; 52/730.4; 52/730.5

(58) Field of Search ..... 52/730.1, 730.2, 52/730.4, 730.5, 732.1, 737.6, 340, 320, 323, 731.2, 732.3

(56) References Cited

U.S. PATENT DOCUMENTS

| | | | | | |
|---|---|---|---|---|---|
| 511,249 | A | * | 12/1893 | Oudin | 52/606 |
| 1,090,171 | A | * | 3/1914 | Schisler | 52/731.2 |
| 1,183,594 | A | * | 5/1916 | Robinson | 264/32 |
| 1,646,183 | A | * | 10/1927 | Bevier | 52/605 |
| 2,082,792 | A | * | 6/1937 | Dean | 52/737.6 |
| 3,999,354 | A | * | 12/1976 | Anter et al. | 52/731.3 |
| 4,557,031 | A | | 12/1985 | Winkler | |
| 4,742,660 | A | | 5/1988 | Vadala | |
| 5,216,863 | A | | 6/1993 | Nessa et al. | |
| 5,397,096 | A | | 3/1995 | Nelson | |
| 5,398,909 | A | * | 3/1995 | Sandwith | 249/207 |
| 5,535,565 | A | | 7/1996 | Majnaric et al. | |
| 5,729,944 | A | | 3/1998 | De Zen | |
| 5,740,648 | A | | 4/1998 | Piccone | |
| 5,806,268 | A | * | 9/1998 | Koller | 52/653.1 |
| 5,953,880 | A | | 9/1999 | De Zen | |
| 6,105,314 | A | | 8/2000 | Stocksieker | |
| 6,195,953 | B1 | * | 3/2001 | Gitter et al. | 52/731.2 |
| 6,250,037 | B1 | * | 6/2001 | Ezumi et al. | 52/592.1 |
| 6,405,504 | B1 | * | 6/2002 | Richardson | 52/461 |
| 6,494,011 | B2 | * | 12/2002 | Ezumi et al. | 52/592.1 |

* cited by examiner

*Primary Examiner*—Jeanette Chapman
(74) *Attorney, Agent, or Firm*—Laurence A. Greenberg; Werner H. Stemer; Gregory L. Mayback

(57) ABSTRACT

A very lightweight tubular building element for the construction of reinforced concrete floors and roofs; providing the formwork for the casting in place of the structural concrete and a high quality finished ceiling at the same time. It is a single component that can be installed easily and efficiently without heavy equipment or special craftsmanship; afterward the component is not removed, but stays permanently integrated in the concrete floor or roof. It forms a deck that is impervious, eliminating cumbersome cleaning during construction and leakage afterward, saving the common need of a costly waterproofing membrane over the slab. The formwork deck, composed of a plurality of the invention component, weighs less than four (4) pounds per square foot; and a single component for a common 15 feet span weighs less than 30 pounds, which can be easily handled by only one laborer. Furthermore, in forming the concrete, the plurality of this component creates hidden closed air spaces in the slab that saves concrete, reduces the overall weight of the building and provides better thermal insulation in comparison with a conventional solid concrete slab of same span, thickness and strength.

20 Claims, 9 Drawing Sheets

LIGHTWEIGHT BUILDING COMPONENT

CROSS REFERENCE TO RELATED APPLICATION

This is a continuation-in-part of application Ser. No. 09/433, 593 filed on Nov. 2, 1999 now abn.

FIELD OF THE INVENTION

This invention relates to a single very light tubular building element for the construction of reinforced concrete intermediate floors/ceilings and roofs. The single building element provides the formwork for the casting in place of the structural concrete and also provides for a high quality finished ceiling at the same time. It is intended for simple installation without heavy equipment into building parts. A series of members are often intended to form an exposed surface when used as a floor or ceiling.

A series of members are constructed and often arranged to be the primary means of containing and supporting a panel or slab of concrete as it cures. An interconnected series of members, according to the present invention, also form a continuous mortar impervious formwork for a concrete slab, and presents an attractive permanently exposed ceiling surface.

PRIOR ART

There have been many suggestions for use of either or both temporary or permanent form members to construct building parts of concrete. These form members can be temporary in nature since they are removed after concrete cures, or can be contained in concrete as permanent parts.

For example:

U.S. Pat. No. 4,742,660 teaches a modular building system of extruded hollow thermoplastic structural components of rectilinear cross-section. These members are made of a special thermoplastic mixture said to resist the elements and are characterized by a fire-resistant outer skin. The concrete is poured inside the thermoplastic components which have internal apertures through which the concrete can flow from one member to another member in a group when they are joined as a wall panel, for example. When the members are to be used in construction of a roof, concrete cannot be used, and metal inserts are called for to assist in stiffening.

U.S. Pat. No. 5,729,944 discloses the use of thermoplastic structural components as permanent formwork. The forms can be used in a series to construct various structures. Concrete is poured inside the thermoplastic components which have internal apertures through which the concrete can flow from one member to another member when they are joined as a wall panel.

U.S. Pat. No. 5,397,096 is illustrative of conventional concrete forming techniques to manufacture a ribbed, reinforced concrete slab. The forming system utilizes concrete displacement pans supported on temporary framework. The patent discloses the problem of concrete leaking out of joints. The leaking material normally is without aggregate, and is sometimes referred to as mortar. When the concrete slab or slab cures, workers must remove the hardened mortar with a chisel, or the like, providing an unsatisfactory surface finish. The bottom surface is neither planar nor finished. The patent suggests the use of additional members to forestall the leakage of mortar.

U.S. Pat. Nos. 4,557,031 and 5,216,863 are illustrative of other expedients to join extruded plastic form members for use in containing concrete inside. The members are normally a part of the cured concrete structure or building component.

U.S. Pat. No. 5,535,565 is illustrative of a containment including a plurality of panels that are interconnected by connector columns and fused together by the passing of electrical current through conductors received within such elements at their points of intersection. The panels are interconnected by sliding one adjacent panel over another panel. A gasket is interposed between a pair of panels to create a watertight environment.

U.S. Pat. No. 5,535,565 is illustrative of a highly sound insulating clay tile for the construction of floors that has an outer substantially parallelepiped shape with symmetrical, laterally projecting portions that act as shoulders for the support of each tile by prefabricated reinforced concrete floor beams.

While the field of reinforced concrete formwork is well-developed, there is still the need for a relatively inexpensive easy-to-use system to form ribbed-concrete slabs with structural formwork components. The system should not be as labor intensive as prior art arrangements. It should use components that are lightweight and yet will control elastic deformation such as is often encountered when steel and aluminum alloy formwork is used to make such ribbed structures. Moreover, each element should be easily aligned with an adjacent member, the alignment means providing an impermeable alignment between adjacent members. Thus, eliminating the need of additional members (e.g. gaskets) or fusing of the adjacent members to accomplish impermeability.

Further, the members making up the formwork should not be filled with concrete, to create the slab. Similarly, the members should include an easy device for placement of reinforcement bars without the need of manual tying or securing of the reinforcement bars together.

It is also desirable to have the ability to incorporate the formwork into the slab and have it serve as an impervious formwork base, eliminating cumbersome cleaning during construction and leakage afterward, and saving the common need of a costly waterproofing membrane over the slab. The formwork should serve for the casting in place of the structural concrete and also should provide for a high quality finished ceiling at the same time, eliminating the need to plaster and otherwise enhance the aesthetic appeal of the ceiling. Finally, the formwork should facilitate hung ceiling installations and also be easily penetrable to hold threaded screws and the like.

BRIEF DESCRIPTION OF THE INVENTION

There is provided an elongated tubular member arranged to be interconnected in a series. Each member is constructed of extruded thermoplastic material, is relatively thin walled, and light in weight. In a preferred embodiment, it will weigh less than four pounds per square foot, i.e., the individual members weigh about 2 pounds per linear foot, so that a 5 meter long member weighs about 32 pounds and can be handled by only one laborer without need of special equipment. It is intended to be incorporated in structural, reinforced ribbed concrete slabs used in roofs and floors.

The members serve as a continuous mortar impervious formwork on the bottom of a poured concrete slab while it is curing. It thus avoids the leakage of concrete mortar through formwork joints during concrete pouring and cure time which leakage can result in honeycomb void defects that cause the structure to be prone to possible future corrosion of steel reinforcement contained in the concrete slab. Such corrosion is often difficult and costly to repair.

The formwork permanently serves as the bottom of the slab. It is an impervious barrier of the type essential for roof construction and thus eliminates the need for an exterior waterproofing membrane. The formwork has transverse, flexural strength and stiffness sufficient to resist vertical and lateral construction loads without significant deformation. It can bear the weight and pressure of wet concrete, needing but few transverse intermediate temporary supports directly under the hollow elements which make up the formwork. For example, a line of 4×4 wooden purlines, spaced about five feet apart over 4×4 wooden shores, also spaced about five feet apart, or equivalent simple systems of metal purlines and shores can be used.

The members are generally formed of a PVC (polyvinyl chloride) alloy conforming with Uniform Building Code (UBC). Any UBC conforming extrudable and light weight similar material of equal or better strength and durability will be suitable. This general type of theremoplastic is lightweight and easily formed by extrusion with many integral convenient features, but has lower modulus of elasticity (stiffness) than most other construction materials. For example, the modulus of elasticity of steel is more than sixty times more than in thermoplastic and the modulus of elasticity for aluminum is more than thirty times more than in thermoplastic.

The center section is like the hat crown and the wings are like a hat brim. A member is defined by a top and a parallel bottom wall interconnected by parallel side walls which are substantially perpendicular to the top and bottom walls. There is an internal generally horizontal wall between the enclosing side walls. Above that internal horizontal wall and limited by the top and side walls is formed a closed rectangular box-like conduit when viewed from an end. In that rectangular space, it is easy to install a band of fiberglass mat to improve thermal insulation of the concrete slab, if desired. Below that internal horizontal wall and connecting it with the bottom and side walls, there is a web of three shorter longitudinal internal walls. One of them is a longitudinal vertical wall extending from the center of the horizontal internal wall (at a central intersection) to the center of the bottom wall. In one embodiment, the other two web walls are symmetrical, sloped down and outward from the center intersection. The side wings taper from a relatively thick area adjacent the side wall to the narrowest area at the end where there is a finger or groove. The sloped walls, side wall bottom wall, and bottom left and right intersections between the bottom wall and side walls are thickened in the area where the wings join the side walls thereby forming an area better able to absorb bending stress which reduces consequent deformation from the side wings when wet concrete is poured above them.

In a second embodiment, the two sloped walls extend symmetrically, are sloped down and outward from a first set of two symmetrical points very close to the center intersection of the horizontal internal wall, through the side walls, and rest at points on the wings near the left and right intersections between the bottom wall and the side walls. Because the sloped walls rest on the wings, they act as tensors and increase the stiffness of each wing sufficient to counter deformation caused by vertical forces acting downward on the top of the wings. In this embodiment, there is no need to taper the thickness of all members connected at the bottom right and left intersections as there is when using the embodiment described above.

There are wing-like webs extending outwardly from each side of each member, having a lower surface, which is substantially on the same plane with the outside lower surface of the bottom wall. The outermost end of one wing has an upwardly extending finger or tongue; and the outermost end of the second wing has a groove like an inverted U, arranged upwardly with the opening facing down. The finger and groove serve as an alignment means. The groove-ending wing fits easily above the tongue-ending wing in a lapping relationship between adjacent members when such members are laid up in a series prepared to receive wet concrete. Since each member has always both wing ending types, for proper lap matching, all members for a formwork deck shall be laid with the tongue wing ending on the same side; that side corresponding with the direction in which the installation proceeds.

The construction technique of the present invention facilitates hung ceiling installations to form a plenum through which heating and air conditioning pipes or ducts are passed.

Further, the construction facilitates the accurate arrangement of steel reinforcing bars because of the unique construction of parts. The invention permits the construction of ribbed reinforced concrete slabs with about one-half the weight of concrete, which might otherwise be required, which slabs are both resistant and stiff.

OBJECTS OF THE INVENTION

It is an object of the invention to provide lightweight, thermoplastic structural formwork members constructed and arranged to be interconnected in a series to serve as formwork for ribbed concrete slabs.

Another object of the invention is to provide lightweight, inexpensive, and easy to install structural members for use in constructing ribbed concrete slabs.

Another object of the invention is to provide formwork for ribbed concrete slabs that forms a continuous impervious structure, eliminating the needs for exterior waterproofing membranes when used in roof construction.

It is another object of the invention to provide formwork which has the longitudinal and transverse flexural strength and stiffness sufficient to resist the weight of the wet and vertical and lateral construction loads, yet needing few transverse intermediate temporary supports while the concrete cures.

It is another object of the invention to provide ribbed concrete formwork having a pleasant appearing exposed surface capable of being used as a finished ceiling with regular longitudinal features or embossing which can be formed during the extrusion process at no extra cost.

Another object of the invention is to facilitate hung ceiling installation in commercial and institutional buildings where it is necessary to have a plenum for heating and air-conditioning pipes and duct work above the ceiling. The formwork provides outward indicia or other markings indicative of areas in which hanger means for the ducts and pipes may be located with assurance of sufficient holding strength of easily penetrated material, for example, to screw in hangers for the hung ceiling, ducts, and pipes.

Another object of the invention is to facilitate installation of thermal insulation for the ribbed slab.

It is yet another object of the invention to facilitate the accurate and easy installation of steel reinforcing bars and/or splice bars in association with the formwork before pouring of the concrete.

Yet another object of the invention is to provide for construction of ribbed reinforced concrete slabs using about one-half the normal weight and volume of concrete as compared to conventional forming techniques.

These and other objects, features, and advantages of the present invention will be more clearly understood and appreciated by review of the following detailed description of the disclosed embodiments and by reference to the appended drawings and claims.

DETAILED DESCRIPTION OF THE INVENTION

Figure 1:
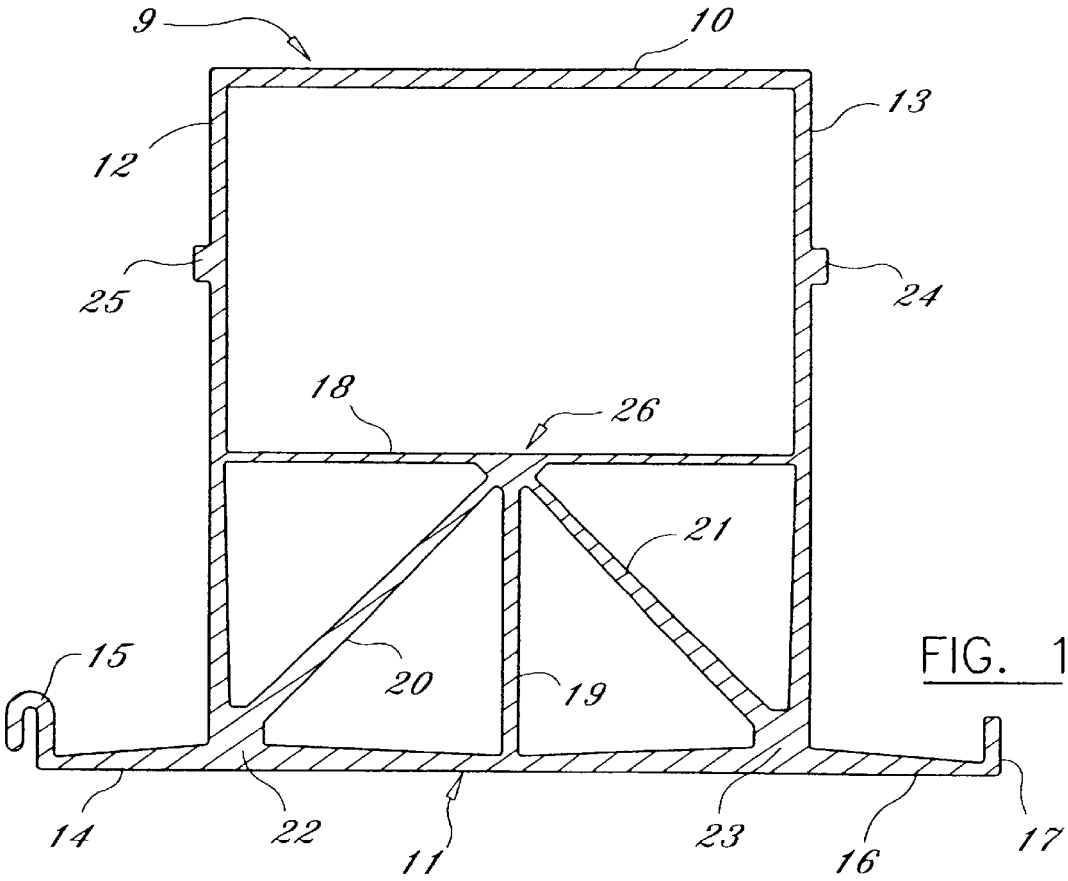
FIG. 1 is a vertical cross-section of one embodiment of a structural member according to this invention.

In FIG. 1 there is shown a tubular structural member 9 according to this invention. It can be generally described as shaped like a top hat in cross-section with an upright central crown and a flat brim about its bottom. It consists of a bottom surface, a top wall 10, interconnected by a pair of substantially parallel sidewalls 12 and 13. Protuberances 24 and 25 provide a mechanical anchorage to the tubular member after the concrete cures, to prevent any separation of the member from the concrete in the event that loads are hung at the bottom of the side walls (e.g. to avoid sliding of the member).

There is a horizontal wall 18 substantially centrally of the member 9, parallel to the top 10 and the bottom wall or floor 11. There is a vertical wall 19 interconnected between the bottom wall 11 and the horizontal wall 18 at a central intersection 26. There are sloped walls 20 and 21 which extend downwardly and outwardly at the same angle to the left and right of the central intersection of the horizontal wall 18 and the vertical wall 19, with respective opposite ends thereof intersecting the corners formed by the intersection of bottom 11 and side walls 12 or 13, respectively. Areas 22 and 23 are referred to as the bottom left and right intersections.

There is a wing extending outwardly from each side of the member 9, forming the brim of the top-hat cross-section. The right-hand wing 16 terminates in an upwardly extending finger or tongue 17. The left-hand wing 14 terminates in a receiving member 15 having an opening to receive the finger 17. In a series of members 9, as shown, for example, in FIG. 3, the finger 17 or 17' is encompassed within a receiving member 15 having an opening or groove to fit the finger 17. Finger 17 and the receiving member 15 act as an alignment means that serves only to align a series of adjacent members according to this invention. The alignment means does not transmit between the adjacent members any structural load. Rather, each one of the matching wings is able to support independently the load directly above each wing.

The walls (sloped walls, side walls, bottom walls) and wings connecting at the bottom left and right intersections are tapered in thickness thereby providing bending stiffness against rotation of these corners. The tapering of the wings increases the stiffness of the wings which serves to absorb bending stress and reduce consequent deformation caused by the vertical construction loads of the wet concrete forces.

Each of the interior walls 20 and 21 tapers from bottom left and right intersections 22 or 23, respectively, to the central intersection 26. The drawings are substantially to scale and in the illustrated preferred embodiment, the taper of walls 22 and 23 is from about four millimeters at the area 22 or 23 to about two millimeters at the area adjacent to 26. The vertical wall 19 is about two millimeters thick in the preferred embodiment. The horizontal wall 18 is about 1.5 millimeters. The top wall 10 is about 3.2 millimeters.

The bottom wall 11 likewise tapers from the center where it is about two millimeters to a thickness of about four millimeters just before the bottom left and right intersections 22 or 23. The wings 14 and 16 taper from about four millimeters adjacent to a wall 12 or 13 to about 2.5 millimeters just before the alignment means 15 or 17. In this embodiment, the receiving member 15 of the alignment means is about 2.5 millimeters in thickness. The receiving member 15 is curved and in the shape of an upside down "U." The outer surface of the curved section of the receiving member 15 has a diameter of about 7.7 millimeters. The height is about 9.5 millimeters from the bottom surface of the wing 14 to the top of the curve of the receiving member 15. The curved portion ends 2.5 millimeters from the bottom of the wall to allow insertion of a finger 17. Finger 17 is about 2.6 millimeters thick and the opening or groove of the receiving member is about 3.0 millimeters wide.

The sidewalls 12 and 13 are about 2.5 millimeters thick from the top wall 10 to the area where the horizontal wall 18 extends across the interior of the member 9. From there, the side walls 12 and 13 taper from about 2.5 millimeters to approximately 4.0 millimeters at the bottom left and right intersections 22 and 23, respectively, in order to increase the stiffness of the bottom left and right intersections. The wing 16 is about 37.1 millimeters from a sidewall to the outer surface of the upwardly extending finger 17. The finger extends upwardly about 9.3 millimeters. The wing 14 is approximately 32 millimeters from the wall 12 to the outside surface of the receiving member 15.

Figure 2:
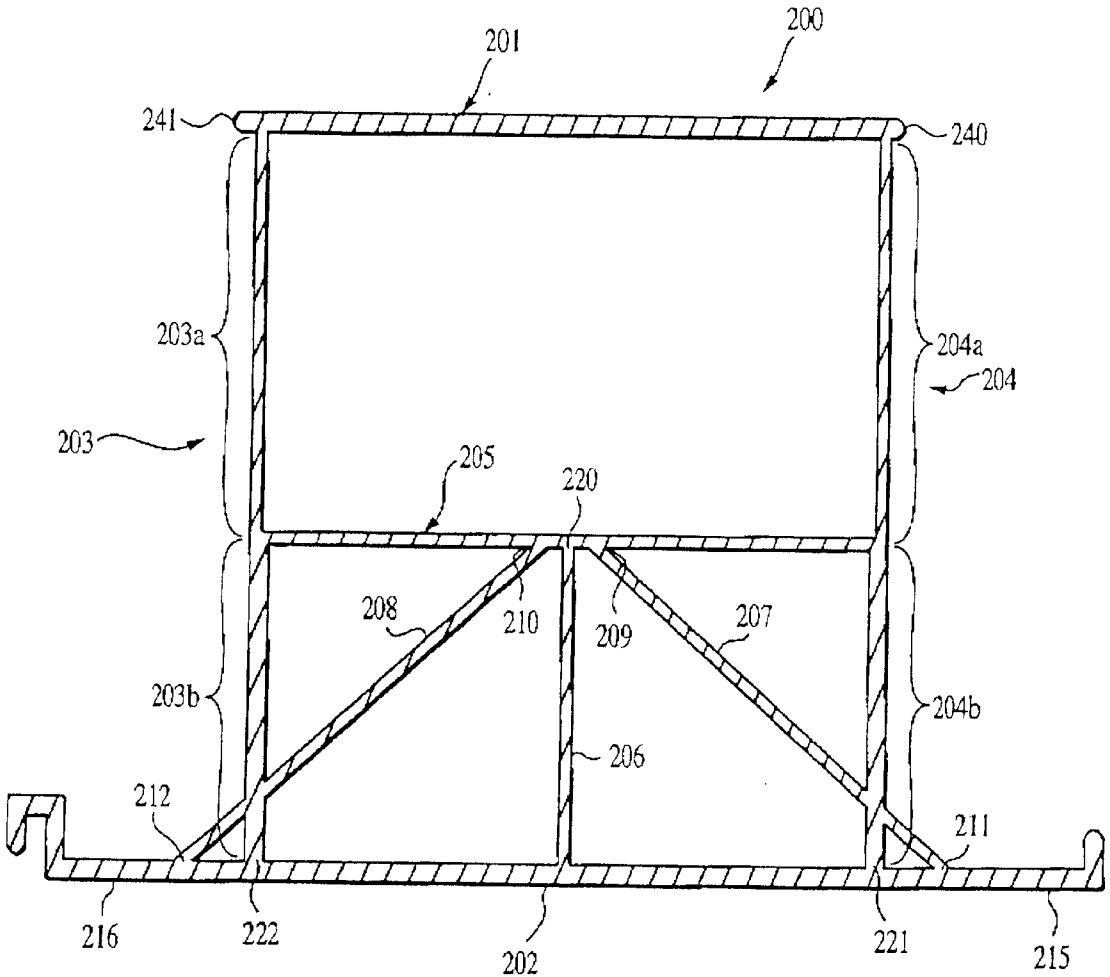
FIG. 2 is an alternate preferred structural member according to this invention in cross-section.

In FIG. 2, there is shown a preferred embodiment of a tubular structural member according to this invention. The design of this alternative embodiment eliminates the need to taper the walls of any member connected at the bottom right and left intersections 221, 222 (side wall, bottom wall or wing) to control within acceptable limits the deformation of the wings caused by the weight of the wet concrete.

FIG. 2 shows an embodiment that has a top 201, a bottom wall 202, and opposed parallel sidewalls 203 and 204. There is a horizontal wall 205 centrally located of the member 200, parallel to the top 201 and the bottom wall 202. There is a vertical wall 206 interconnected between the bottom wall 202 and the horizontal wall 205 extending from the horizontal wall at a central intersection 220. A first and second sloped wall 207 and 208 extend downwardly and outwardly at the same angle from a first set of right 209 and left 210 points proximate to the central intersection 220. The sloped walls 207, 208 extend through the side walls 203, 204, with opposite ends thereof joined at the wings 215, 216 at a second set of right and left points 211, 212 proximate to the bottom right and left intersections 221, 222 formed by the bottom wall and sidewalls. In other words, the opposite ends of the sloped walls 207, 208 rest on the wings 215, 216 at a point proximate to the intersection 221, 222 of the sidewalls 203, 204 and bottom wall 202.

In the embodiment of FIG. 2, the tensors, 207, 208 intersect the wings at points 211, 212, respectively, which should be proximate to the bottom left and right intersections 221, 222. The tensors cover a portion of the wings between the bottom left and right intersections 221, 222 and points 211, 212 and form a triangle that is void of concrete. The portions of the side walls (below the intersection of the tensors with the sidewalls) and the portion of the wings between 211, 212 and 221, 222 respectively, are kept small to make these portions very rigid. As a result, the points from which the wings cantilever is from points 211, 212 to the free ends of the wings. The result is that the bending moment at the attached end of the cantilever (points 211, 212) and the deflection at the tip of the free end of the wings is greatly reduced. Therefore, there is no need to taper any wall or wing as there is in the first embodiment.

To further increase rigidity of the section of the member below the horizontal wall, the side walls from the right and left intersections 221, 222 to the horizontal wall 205 may be thicker (203*b* and 204*b*), about 3.2 millimeters thick, than the sidewalls that extend from the horizontal wall 205 to the top walls 201 (203*a* and 204*a*), which are about 2.5 millimeters thick.

The top wall is longer to extend slightly beyond the side walls to form small protuberances 240, 241 which provide a mechanical anchorage to the tubular member after the concrete cures, to prevent any separation of the member from the concrete in the event that loads are hung at the bottom of the side walls. Protuberances 240 and 241 are approximately 4 millimeters thick and project outward about 3 millimeters.

The sloped walls 207, 208 are thinner, about 1.5 millimeters in thickness because they are not intended to provide any bending stiffness, but act as a tensor. The horizontal wall and vertical wall are each about 2.0 millimeters thick and the top wall is about 3.2 millimeters thick. The bottom wall or floor is about 3.0 millimeters thick. The wings are about 3.0 millimeters thick. Overall, the thickness of each wall and wing has a thickness of 3.2 millimeters.

Points 211, 212 are about 8.0 millimeters from the bottom left and right intersections 221, 222 of sidewalls 203, 204 with bottom wall 202. The distance from the bottom and right intersections to the finger 17 is about 33.6 millimeters. The distance from point 211 to the finger is about 25.6 millimeters. The distance from the bottom left intersection 222 to the receiving member is about 36.2 millimeters. The distance from point 212 to the receiving member is about 20.5 millimeters.

In the construction of the embodiments shown in FIGS. 1, and 2, all corners, both inside and outside, should be rounded to aid in the extrusion process.

Figure 3A:
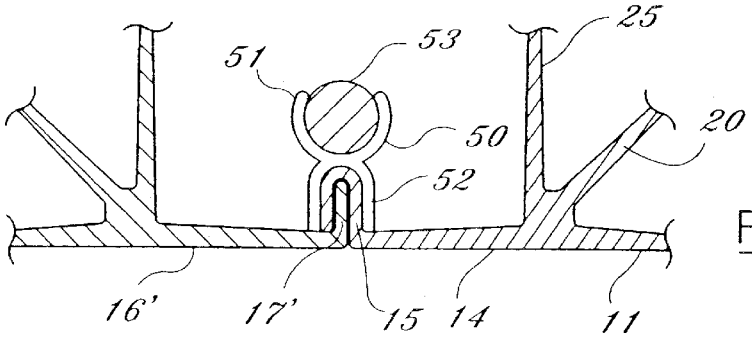
FIG. 3A is a partial cross-section of a portion of two adjacent members of the type shown in FIG. 1, having a reinforcement chair with one reinforcement bar.
Figure 9:
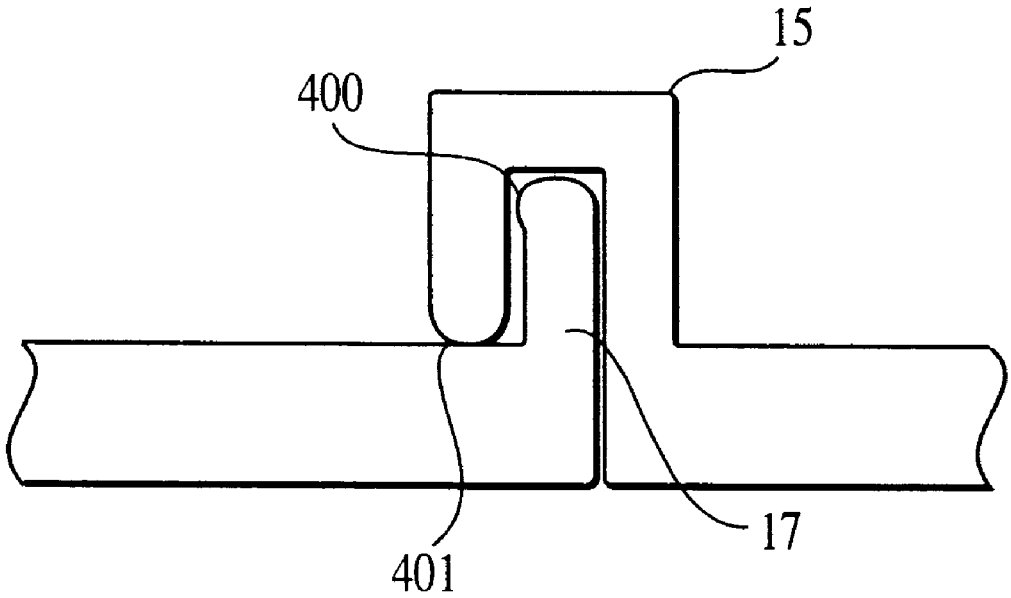
FIG. 9 is a partial cross section of two adjacent members aligned via an alignment means having a longitudinal lobe.

In FIG. 3A, which is a partial cross-section of some adjacent parts of an adjacent pair of structural members 9, there is shown a wing 14 having a receiving member 15 with an opening which has received within it an upwardly extending finger or tongue 17' on a wing 16' of an adjacent member 9 for alignment and water-proofing purposes. The fitting relationship is such that mortar will not flow through the alignment means, thus making the deck impermeable in nature. The alignment means includes a wing 14 that has a receiving member 15 about 0.4 millimeters wider than the thickness of finger 17 to allow easy assembly, and the end of the receiving member 15 rests on top of wing 16' and that contact is made tighter with the weight of the concrete. No fastening device or securing device is necessary to secure the alignment of adjacent members. This arrangement is constructed and arranged to provide a simple way to align the members while preventing passage of mortar, thereby creating an impermeable formwork, It is not necessary to align the members of the present invention via the aligning means to form a deck. Each member could simply be laid with the finger-ending wing at the same side, right or left. Therefore, the wings with the receiving ends each will always face and lap the finger of the adjacent member. Installation proceeds in the same direction of the finger edge side, toward right or left, chosen for the finger side. Because the wing having the receiving member is longer and laps over the finger, it is subject to a slight increased deflection when receiving wet concrete than that of the wing having the finger. This difference in deflection of the wing having the receiving member causes the receiving member to press down contacting the adjacent wing (see FIG. 9 showing point of contact as 401). The purpose of the alignment means is to create an impermeable deck.

The present invention also includes a reinforcement chair 50 to support reinforcement bars. The chair 50 is removably mountable on the receiving member 15 of the alignment means. FIG. 3A shows a reinforcement chair 50 made also of extruded plastic, having an upward opening 51 to receive a reinforcement bar 53 and a downward opening 52 to mount the receiving member 15 of the alignment means. In this embodiment, the downward and upward openings are curved in nature to cooperate with the curved alignment means. The downward opening 52 is of sufficient size to engage in a close-fitting but loose relationship with the outer surface of revolution of the opening of the receiving member 15. The downwardly opening 52 closely conforms to the outer surface of revolution of receiving member 15 and has legs that extend to the top of wings 14 and 16. The upper opening 51 is sized to accept a reinforcing bar 53 in a close-fitting snap-on relationship. The legs are long enough to prevent the reinforcement chair 50 from falling to either side.

Figure 3B:
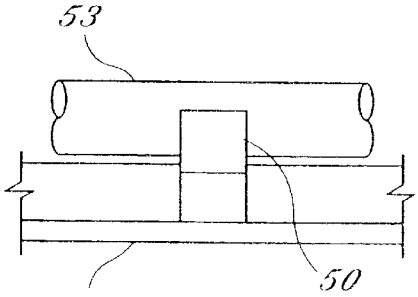
FIG. 3B is a partial side view of the arrangement of the reinforcement chair of FIG. 3A.

In FIG. 3B there is shown a side elevation of a portion of the parts of FIG. 3A, indicating the relationship of the reinforcing bar 53, the reinforcement chair 50, and the plane in which the upper surface of the wing 14 exists. The chairs are spaced about four feet apart. The chairs are about one-half to three-quarter inches long, measuring along the axis of a reinforcing bar or "rebar" as they are sometimes called.

Figure 4A:
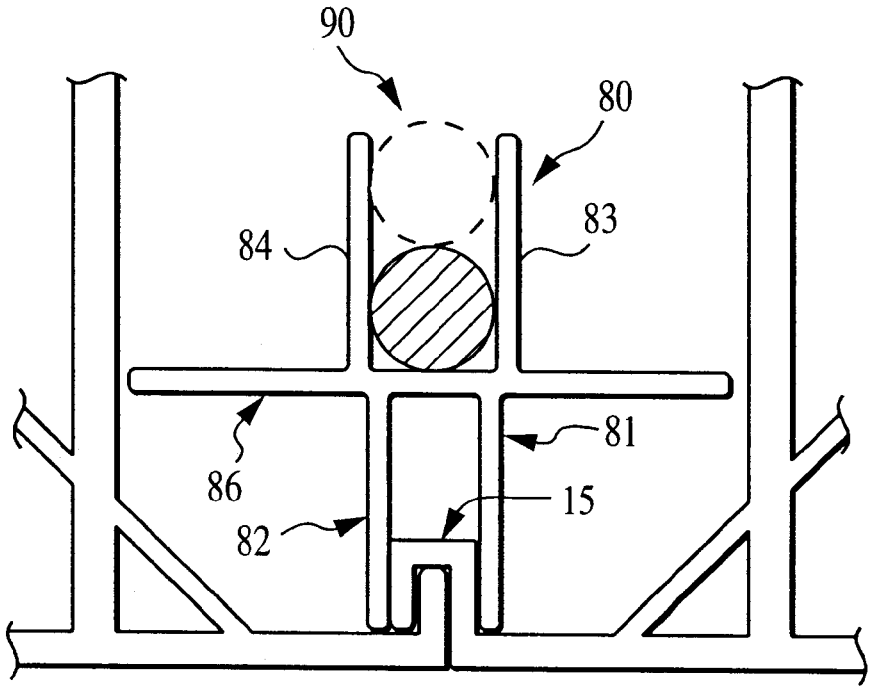
FIG. 4A is a partial cross-section of a portion of two adjacent members of the type shown in FIG. 2, having a reinforcement chair with a plurality of reinforcement bars (or, alternatively, a reinforcement bar and a splice bar)

In FIG. 4A there is a shown a second embodiment of the reinforcement chair of this invention. The shape of the reinforcement chair 80 is rectangular in nature and would, for example, serve to cooperate with the alignment means shown in FIG. 2. No embodiment is limited to cooperate with a particular reinforcement chair and thus, may be interchangeable as long as the alignment means are of the same shape for cooperation with the reinforcement chair.

FIG. 4A shows a reinforcement chair 80 that is elevated with legs 81, 82 above the receiving member 15 of the alignment means. The chair includes a downward opening formed by the two bottom legs, 81 and 82, and an upward opening formed by two upper legs 83, 84 to receive a plurality of reinforcement bars 90 (or a reinforcement bar and a splice bar). A horizontal bar 86 extends almost the length between the sidewalls of two adjacent members and serves to divide the upper legs 83, 84 from the bottom legs 81, 82, and also to support the plurality of reinforcement bars. Because of the elevated nature of the reinforcement chair 80, it is necessary to have a horizontal bar 86 that nearly extends the length between two sidewalls of two members in order to prevent the chair from falling to one side once the wet concrete is poured. Moreover, this embodiment serves to comply with fire codes and other regulations normally imposed in school buildings and other like buildings.

The upper legs, lower legs and horizontal bar are about 2.0 millimeters thick. The length of the horizontal bar is about 63 millimeters. The distance between the adjacent members in FIG. 4A is about 64.7 millimeters. The opening between the two upper legs is about 13 millimeters wide and the opening between the two lower legs is about 8 millimeters wide. The length of the chair is about 15 millimeters.

Figure 4B:
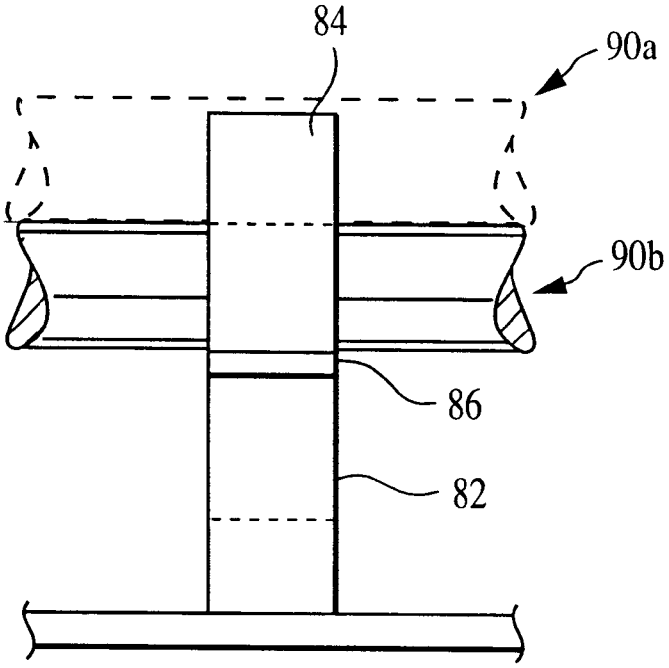
FIG. 4B is a partial side view of the arrangement of the reinforcement chair of FIG. 4A.

FIG. 4B shows a side view of the reinforcement chair shown in FIG. 4A. The reinforcement bar 90*a* is directly on top of another reinforcement bar 90*b* due to the upper legs 83, 84. Ordinarily, reinforcement bars are placed right next to each other in the same horizontal plane and tied together manually for purposes of keeping such bars together in place. This embodiment avoids any manual securing of the reinforcement bars. A laborer need only drop in place the reinforcement bars or reinforcement bar and splice bar in the chair.

Figure 5:
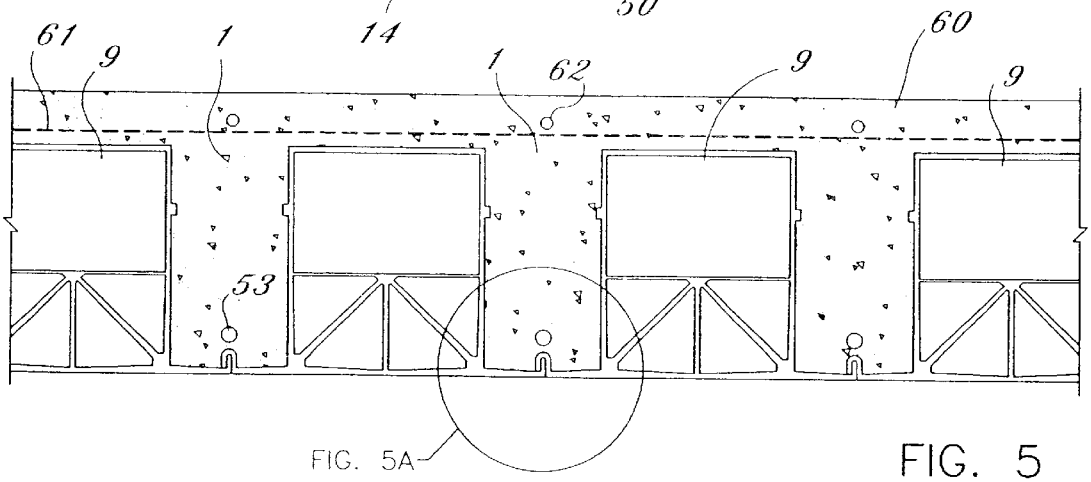
FIG. 5 is a transversal cross-section of a series of the tubular members 9 in a ribbed concrete slab 60.

In FIG. 5 there is shown a plurality of the members 9 in a ribbed concrete slab 60. There is shown a wire mesh reinforcement sheet 61 laid on the top surface of the series of the plastic members 9. A series of parallel reinforcing bars 62 are tied to the wire mesh 61 arranged parallel to the reinforcing bars 53, which reinforcing bars 53 are supported by a series of reinforcement chairs 50 (not shown). As can be seen, there is formed a series of hollow enclosed valleys. At the bottom of each valley, the mating alignment of adjacent members are engaged in mortar impervious contiguous relation.

Figure 5A:
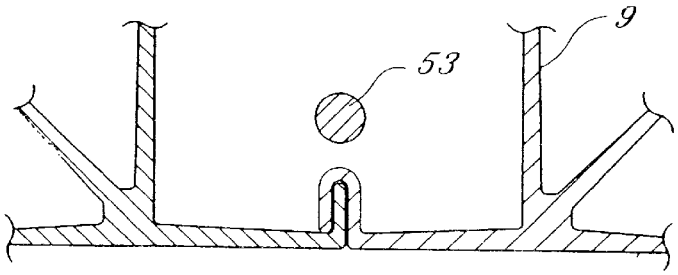
FIG. 5A is a detail of FIG. 5 showing a reinforcing bar 53 in the concrete slab 60 above the longitudinal alignment means of an adjacent pair of the tubular members.

Looking for the moment at FIG. 5A, which is a detail of a portion of FIG. 5, parts are enlarged to better show the relationship of reinforcing bar 53 in the concrete slab 60.

Figure 5B:
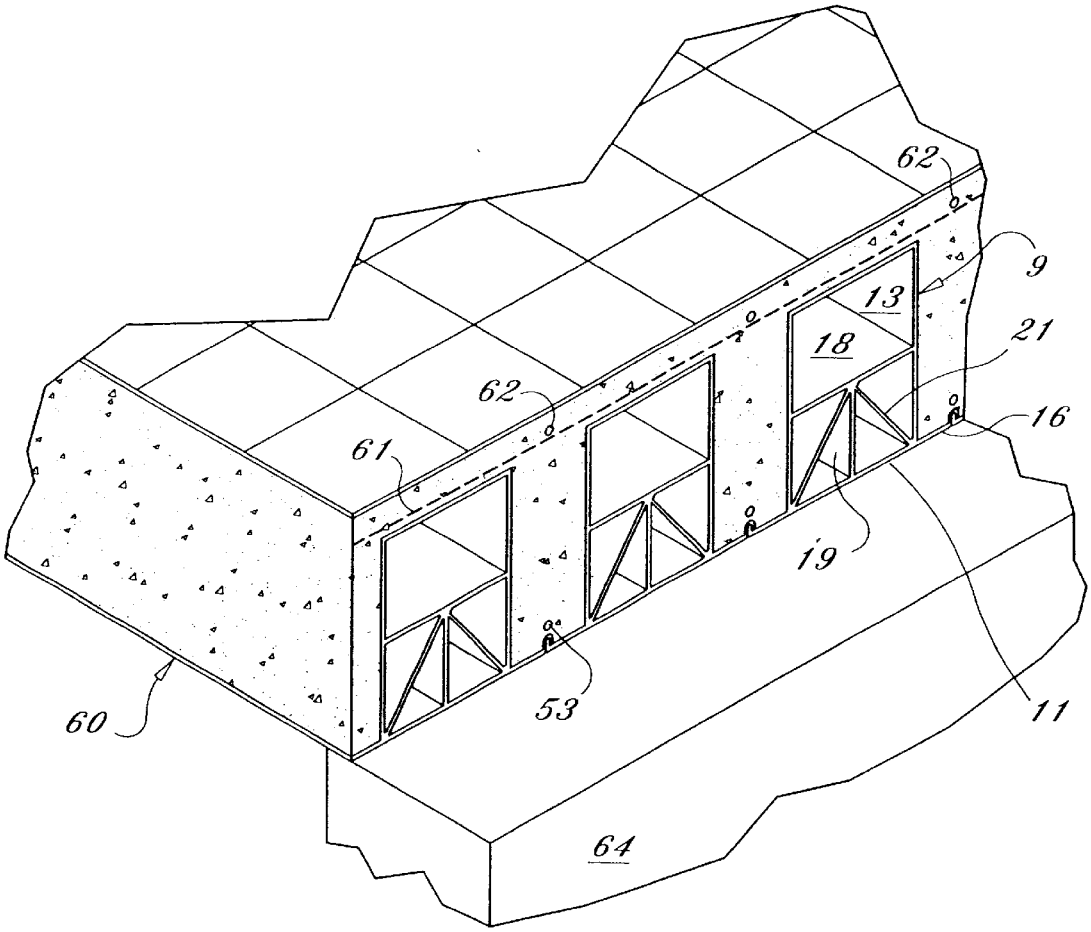
FIG. 5B is a perspective view of a ribbed concrete slab according to this invention.

In FIG. 5B, there is shown a perspective view of a portion of a slab construction, shown in FIG. 5 in which the hollow tubular nature of the member 9 can be better appreciated. This view emphasizes the lightweight nature of a ribbed slab using a series of hollow thermoplastic members according to this invention.

Figure 6:
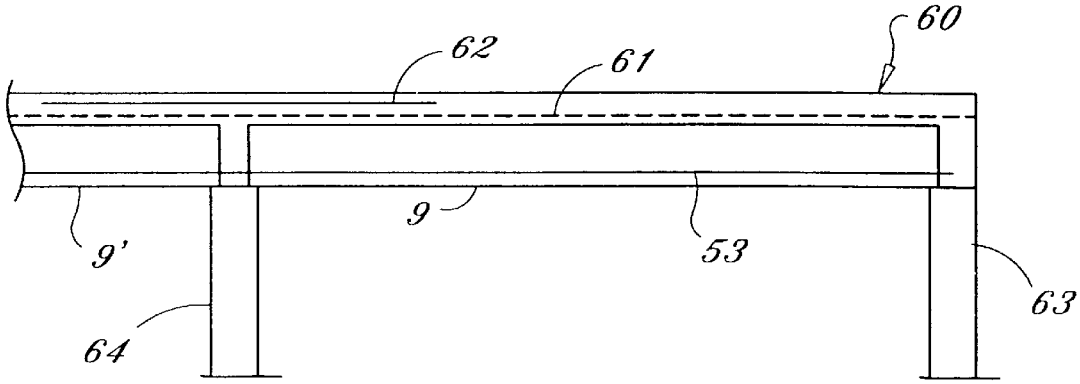
FIG. 6 is a schematic side elevation of an arrangement of slabs of the type shown in FIG. 5, supported on vertical walls.

In FIG. 6, there is shown a ribbed concrete slab as it might be supported in a building. Element 63 is an outside wall and element 64 is an intermediate wall or beam support. Thermoplastic members 9 and 9' are shown in an appropriate fashion supported by the walls 63 and 64. Top rebar 62 is placed exactly above the intermediate supports as shown in FIG. 6. The exposed nature of the ceiling is likewise schematically demonstrated. In FIG. 6, we have shown concrete poured about the ends of the slabs on top of the walls. There are simple means, like tape, provided to prevent uncured concrete from entering the plastic members 9 and 9'. The top rebar 62 serves to resist the reverse bending force that occurs above the intermediate support and also to avoid cracking through the joint between 9 and 9'. A series of such top rebars is similarly positioned across all such interior joints over the length and width of the structure.

Figure 7A:
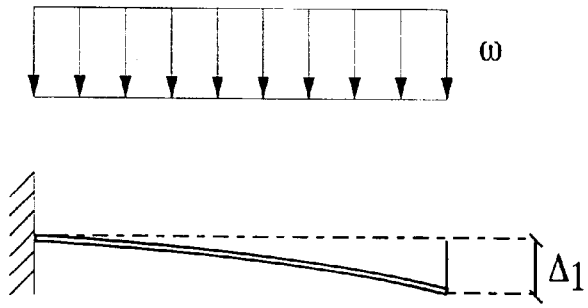
FIGS. 7-A, 7-B and 7-C are schematic illustrations of the elastic deformation of the cantilever and the maximum deflection at the tip when subject to uniform load w, and attached to an elastic element.
Figure 7B:
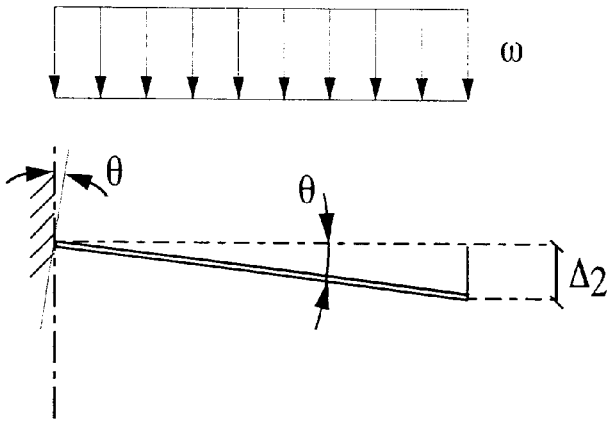
Figure 7C:
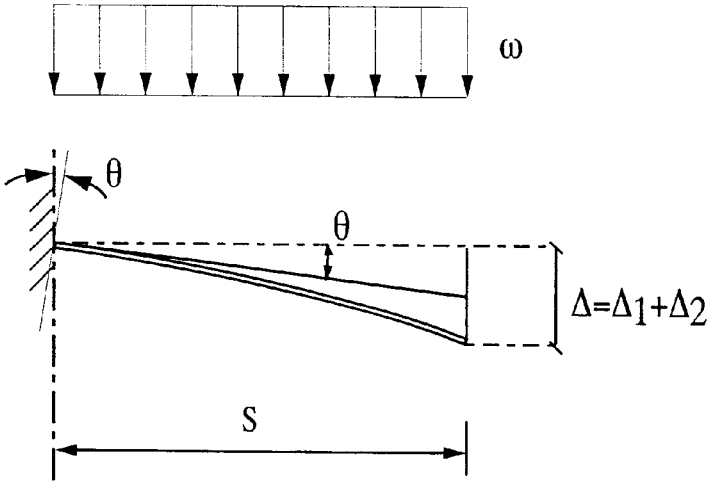

Now turning to FIGS. 7A–7C, as stated above, the wings project outward from the bottom left/right intersections (Tube) in the same plane of the bottom, as if extensions of the bottom wall formed a ceiling. The concrete ribs of the slab are formed between the side walls of the parallel adjacent members and have the wings of those members forming the bottom of each rib and matching their edges to prevent leakage of the mortar from the wet concrete above them. In the first and second embodiment, the match of the wings is at the center of rib bottom form. Each wing carrying structurally and independently the wet concrete above it, being in cantilever from the side wall in one embodiment and mostly in cantilever (from the points 211, 212 outward in FIG. 2) in the second embodiment.

FIGS. 7A–7C illustrate the elastic deformation of the cantilever and the maximum deflection at the tip when subject to uniform load w, and attached to an elastic element.

FIG. 7A shows the deformation assuming the cantilever element is elastic but the attachment (rest of the member) of it is absolutely rigid. The tip deformation will be called $\Delta_1$.

FIG. 7B shows the deformation assuming the cantilever is absolutely rigid, but the attaching element (rest of the member) is deformable when subject to the bending moment caused by the cantilever element. The elastic deformation of the attaching element will be a rotation of the attaching plane, represented by the angle ø. The tip of the cantilever will move downward a distance $\Delta_2 = ø \times S$.

FIG. 7C represents the actual condition, applying the principle of superposition to the above assumptions made for FIGS. 7A and 7B. The actual deflection of the tip of the cantilever being $\Delta = \Delta_1 + \Delta_2$. The analysis shows the importance and the need to control the rotation of the point of attachment of the wing to reduce $\Delta$ by reducing $\Delta_2$.

As a result, there is a need to provide substantial stiffness both to the wings in cantilever and to the tube at the two bottom corners where these wings are attached, to avoid unpleasant deflection of the wings. In the first embodiment shown in FIG. 1, this is done by providing the bottom left and right intersections formed by the sidewalls and bottom wall (including sloped walls) with bending stiffness against rotation of these corners. The tapered thickness of these walls, thicker at the bottom left and right intersection and thinner at the other ends, is an effective form to obtain the needed rigidity. In the second embodiment, a thin tensor extends out to the top of each wing, reducing the cantilever portion of the wing and the forces that cause rotation of the bottom right and left intersections. With these conditions, the uniform thickness is rigid enough and easy to extrude.

Figure 8A:
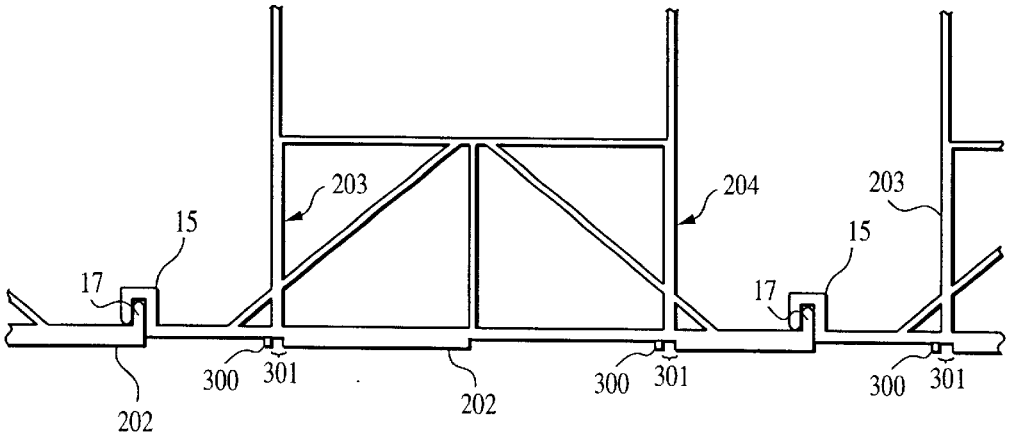
FIG. 8A is a cross sectional view of markings on a ceiling when using the tubular construction members according to this invention (the markings are exaggerated in this view).
Figure 8B:
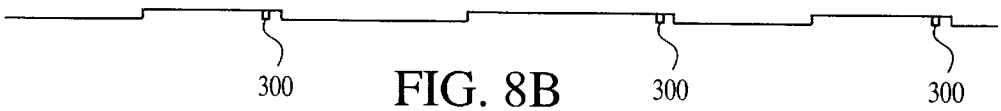
FIG. 8B is a cross sectional view of the bottom walls and wings showing only the marks when using tubular construction members according to this invention.

It can also be appreciated that the structure of this invention, including the plastic members 9 facilitate hung ceiling installation in commercial and industrial buildings where it is necessary to have plenums to pass heating and air-conditioning ducts and pipes. In the embodiment shown in FIGS. 8A and 8B, longitudinal markings 300 at the intersection of the side walls 203, 204 with the bottom wall 202 serve to delineate the boundaries of the side walls 203, 204 so that a threaded screw or other like material can be placed in the middle 301 of the bottom of the side walls 203, 204. As shown in FIG. 8B, after installation of a slab construction according to this invention, these marked areas 300 will be detectable on the exposed ceiling surface (the variation in thickness of the wings and bottom walls in FIG. 8A and 8B are exaggerated for exemplary purposes). Threaded screws easily penetrate the plastic material from which members 9 are made of and are much less expensive and easier to install than power-driven nails and the like, which normally are used with concrete slabs. The variation in the visible texture at the bottom-exposed surface is about 0.5 millimeters high.

The hollow interior of the structural members 9 and 40 facilitate the installation of thermal insulation, for example, by filling the longitudinal tubular portions with fiberglass, either blown or by inserting pieces of insulation mats.

Another embodiment for the alignment means is shown in FIG. 9 which includes an alignment means having a finger with a longitudinal lobe 400. The lobe 400 is a means of separation that serves to ensure that the finger 17 does not come in direct contact with the left inner side of the receiving member 15, to avoid capillary action to raise water between them. As shown in FIG. 9, the receiving member comes in contact with the wing having the finger at point 401.

Use of the members according to this invention facilitates the accurate and precise arrangement of steel reinforcing bars, not only because of the novel seat construction, but because it can be accomplished without the cost of the labor involved in tying reinforcing wires which is the usual practice.

Construction according to this invention provides for reinforced concrete slabs of about one-half the weight and concrete volume for slabs with the same strength and stiffness requirements. Approximately 80 millimeters or 3.25 inches average thickness of concrete (from top of slab to top of wings buried in concrete) can be used to build a roof slab span of about six meters or 20 feet. In residential intermediate size floor slabs, they can be up to about five meters or 16 feet at the same concrete thickness. Conventionally, the latter would require 150 millimeters or six inches in normal reinforced concrete slab.

The time and labor required to build a ribbed concrete slab, according to the invention, is substantially reduced for many reasons. For example, the task of placing the formwork is much simpler because the present invention is a single component that can be installed easily and efficiently without heavy equipment or special craftsmanship; afterward the component is not removed, but stays permanently integrated in the concrete floor or roof. Additionally, the amount of time to install slab reinforcement is drastically reduced because there is no need to wire the reinforcing bars in place. Since about one-half the volume of concrete is required, additional time and labor are saved. No formwork stripping is needed. Ceiling plastering, painting and the like can be eliminated.

In the above description, exemplary dimensions have been given in describing the operation of structural members when incorporated in a ribbed concrete slab forming process. It should be understood by those skilled in the art that other dimensions can be calculated, using conventional techniques, to determine appropriate dimensions for installations other than exemplary ones described herein.

For performance verification we have used properties of available thermoplastic material. It should be likewise understood that plastic materials other than the exemplary one described above which will provide the properties described to a member made therefrom are considered the functional equivalent of those described herein and can thus likewise be used.

Having thus described the invention in detail, what is claimed is:

1. Tubular lightweight and extruded plastic structural members for use in constructing ribbed concrete roof and mid-level floor/ceiling slabs comprising, An elongate tubular member, the member being generally rectilinear in cross-section, having four longitudinal walls, comprising a pair of side walls, a floor, and a top, there being substantially centrally located a horizontal wall substantially parallel to the top and the floor, and extending between the side walls to form upper and lower hollow conduit sections of the interior of the member, there being a vertical wall substantially parallel to the side walls, and extending from the horizontal wall at a central intersection to the floor substantially centrally thereof, there also being a first and a second sloped wall each extending downwardly and outwardly at approximately the same angle from the central intersection with opposite ends thereof joined to a bottom right and left intersection of a side wall and the floor, the bottom surface of the floor extending beyond the side walls on each side of the member, but lying in substantially the same plane, and serving as the flat bottom or wing-like longitudinal projections on each side of the member, the outer longitudinal edge of each wing including cooperating alignment means arranged to align each member with a next adjacent wing edge in a moisture resistant relationship when a plurality of the members are interconnected to form a concrete form, wherein said sidewalls, bottom wall and wings are gradually tapered from a thickest portion at the bottom left and right intersections to a thinnest portion to increase the stiffness of said wings.

2. In a tubular structural member of claim 1, there being protuberance means longitudinally along the outer side wall constructed and arranged for engagement by adjacent cured concrete in a slab.

3. In the tubular structural member of claim 2, there being longitudinal markings formed during the extrusion of said member to facilitate hung ceiling installation in commercial and industrial buildings.

4. The tubular structural member of claim 3, wherein the alignment means is of an upwardly extending finger-like ridge along one wing edge and a complimentary receiving member having an opening to fit said ridge along the other wing, the finger and receiving member constructed and arranged to engage in a substantially mortar impervious mating relationship.

5. The tubular structural member of claim 4, wherein the finger of the receiving member comprises a longitudinal lobe to prevent passage of water caused by capillary action.

6. In the tubular structural member of claim 5, wherein said member further comprises a reinforcement chair to support a reinforcement bar above and substantially parallel to the wing alignment means of adjacent wings when concrete is being cast upon a group of aligned structural members, said chair being removably mountable to said alignment means.

7. In the tubular structural member of claim 5, wherein said member further comprises a reinforcement chair to support a plurality of reinforcement bars, above and substantially parallel to the wing alignment means of adjacent wings when concrete is being cast upon a group of aligned structural members, said chair being removably mountable to said alignment means.

8. In the tubular structural member of claim 5, wherein said member further comprises a reinforcement chair to support a reinforcement bar and a splice bar, above and substantially parallel to the wing alignment means of adjacent wings when concrete is being cast upon a group of aligned structural members, said chair being removably mountable to said alignment means.

9. Tubular lightweight and extruded plastic structural members for use in constructing ribbed concrete roof and mid-level floor/ceiling slabs comprising, an elongate tubular member, the member being generally rectilinear in cross-section, having four longitudinal walls, comprising a pair of side walls, a floor, and a top, said sidewalls and floor forming a bottom left and right intersection, there being substantially centrally located a horizontal wall substantially parallel to the top and the floor, and extending between the sidewalls to form upper and lower hollow conduit sections of the interior of the member, there being a vertical wall substantially parallel to the side walls, and extending from the horizontal wall at a central intersection to the floor substantially centrally thereof, the bottom surface of the floor extending beyond the side walls on each side of the member, but lying in substantially the same plane, and serving as the flat bottom or wing-like longitudinal projections each of a uniform thickness on each side of the member, the outer longitudinal edge of each wing including cooperating alignment means arranged to align each member with a next adjacent wing edge in a moisture resistant relationship when a plurality of the members are aligned to form a concrete form, there also being a first and a second sloped wall each extending downwardly and outwardly at approximately the same angle from a first set of right and left points proximate to said central intersection, through said side walls, with opposite ends of said sloped walls joined to said wings at a second set of right and left points proximate to said bottom right and left intersections.

10. In a tubular structural member of claim 9, there being protuberance means at a right and left end of said top wall constructed and arranged for engagement by adjacent cured concrete in a slab.

11. The tubular structural member of claim 10, wherein the alignment means consists of an upwardly extending finger-like ridge along one wing edge and a complimentary receiving member having a opening to fit said ridge along the other wing, the finger and receiving member constructed and arranged to frictionally engage in a substantially mortar impervious mating relationship.

12. In the tubular structural member of claim 11, there being longitudinal markings formed during the extrusion of said member to facilitate hung ceiling installation in commercial and industrial buildings.

13. The tubular structural member of claim 12, wherein the finger of the receiving member comprises a longitudinal lobe to prevent passage of water caused by capillary action.

14. In the tubular structural member of claim 13, wherein said member further comprises a reinforcement chair to support a reinforcement bar, above and substantially parallel to the wing alignment means of adjacent wings when concrete is being cast upon a group of aligned structural members, said chair being removably mountable to said alignment means.

15. In the tubular structural member of claim 13, wherein said member further comprises a reinforcement chair to support a plurality of reinforcement bars, above and substantially parallel to the wing alignment means of adjacent wings when concrete is being cast upon a group of aligned structural members, said chair being removably mountable to said alignment means.

16. In the tubular structural member of claim 13, wherein said member further comprises a reinforcement chair to support a reinforcement bar and a splice bar, above and substantially parallel to the wing alignment means of adjacent wings when concrete is being cast upon a group of aligned structural members, said chair being removably mountable to said alignment means.

17. Tubular lightweight and extruded plastic structural members for use in constructing ribbed concrete roof and mid-level floor/ceiling slabs comprising:

an elongate tubular member, the member being generally rectilinear in cross-section, having four longitudinal walls, comprising a pair of side walls, a floor, and a top, said sidewalls and floor forming a bottom left and right intersection;

there being substantially centrally located a horizontal wall substantially parallel to the top and the floor, and extending between the sidewalls to form upper and lower hollow conduit sections of the interior of the member;

there being a vertical wall substantially parallel to the side walls, and extending from the horizontal wall at a central intersection to the floor substantially centrally thereof;

the bottom surface of the floor extending beyond the side walls on each side of the member, but lying in substantially the same plane, and serving as the flat bottom or wing-like longitudinal projections each of a uniform thickness on each side of the member, the outer longitudinal edge of each wing including cooperating alignment means arranged to align each member with a next adjacent wing edge in a moisture resistant relationship when a plurality of the members are aligned to form a concrete form, the alignment means having an upwardly extending finger-like ridge along one wing edge and a complimentary receiving member having an opening to fit said ridge along the other wing, the finger and receiving member constructed and arranged to engage in a substantially mortar impervious mating relationship, and the finger having a longitudinal lobe to prevent passage of water caused by capillary action;

there also being a first and a second sloped wall each extending downwardly and outwardly at approximately the same angle from a first set of right and left points proximate to said central intersection, through said side walls, with opposite ends of said sloped walls joined to said wings at a second set of right and left points proximate to said bottom right and left intersections;

there being protuberance means at a right and left end of said top wall constructed and arranged for engagement by adjacent cured concrete in a slab; and there being longitudinal decorative embossing formed during the extrusion of said member to facilitate hung ceiling installation in commercial and industrial buildings.

18. In the tubular structural member of claim 17, wherein said member further comprises a reinforcement chair to support a reinforcement bar, above and substantially parallel to the wing alignment means of adjacent wings when concrete is being cast upon a group of aligned structural members, said chair being removably mountable to said alignment means.

19. In the tubular structural member of claim 17, wherein said member further comprises a reinforcement chair to support a plurality of reinforcement bars, above and substantially parallel to the wing alignment means of adjacent wings when concrete is being cast upon a group of aligned structural members, said chair being removably mountable to said alignment means.

20. In the tubular structural member of claim 17, wherein said member further comprises a reinforcement chair to support a reinforcement bar and a splice bar, above and substantially parallel to the wing alignment means of adjacent wings when concrete is being cast upon a group of aligned structural members, said chair being removably mountable to said alignment means.

* * * * *